United States Patent [19]

Elrod et al.

[11] Patent Number: 4,460,657

[45] Date of Patent: Jul. 17, 1984

[54] THINNING CONTROL IN SUPERPLASTIC METAL FORMING

[75] Inventors: Samuel D. Elrod, Seattle; DeVere V. Lindh, Auburn, both of Wash.

[73] Assignee: The Boeing Company, Seattle, Wash.

[21] Appl. No.: 245,803

[22] Filed: Mar. 20, 1981

[51] Int. Cl.[3] ..... B21D 24/00; B21D 26/00

[52] U.S. Cl. ..... 428/600; 148/118 A; 148/11.5 R

[58] Field of Search ..... 428/600; 148/11.5 R

[56] References Cited

U.S. PATENT DOCUMENTS

| | | | |
|---|---|---|---|
| 3,340,101 | 9/1967 | Fields et al. | 148/11.5 R |
| 3,420,717 | 1/1969 | Fields et al. | 148/11.5 R |
| 4,113,522 | 9/1978 | Hamilton et al. | 148/11.5 R |
| 4,233,831 | 11/1980 | Hamilton et al. | 148/11.5 R |
| 4,299,111 | 11/1981 | Fayal et al. | 148/11.5 R |

*Primary Examiner*—Veronica O'Keefe

*Attorney, Agent, or Firm*—Morris A. Case; B. A. Donahue

[57] ABSTRACT

Flat metal stock is contoured into a shaped blank prior to being superplastically formed into a finished part. The stock is shaped in steps.

6 Claims, 5 Drawing Figures

THINNING CONTROL IN SUPERPLASTIC METAL FORMING

BACKGROUND OF THE INVENTION

It is known that various metals may be superplastically formed into various shapes under elevated temperatures while under pressure. The parts are formed from sheets of metal blanks that are blown into or against a mold to obtain the desired finished part. Often the mold will contain shaped metal parts located to act as reinforcements to be pressed against by the forming sheets, then the reinforcement and the form sheets are diffusion bonded to obtain the finished part. Whether the sheet of metal is used alone or is used in combination with metal reinforcements, one always uses the metal sheet in superplastic forming due to the complex shapes desired. Metals that can be superplastically formed tend against excessive thinning with consequent rupture; however, the sheet is thinned by the elongation that takes place. This requires the use of a blank with sufficient starting thickness to assume an acceptable minimum thickness in critical areas. The excess material in the non-critical areas either leaves a weight penalty or requires removal of metal from the complex shape after forming.

SUMMARY OF THE INVENTION

Metal stock is contoured while in the flat condition with the thickness selectively reduced by processes such as machining or chemical milling or coining to form a starting metal blank. The blank will be the thickest in the areas to be subjected to the greatest elongation. The shaped blank is then formed at elevated temperature by pressure from an inert gas.

DETAILED DESCRIPTION

Metals such as aluminum or titanium alloys may be superplastically formed into intricate shapes. When superplastically forming a part from titanium a sheet of the metal making up a blank is placed between parts of a mold, raised to a temperature of from about 1450° F. to about 1850° F., and pressures of from about 50 psi to about 400 psi exerted by an inert gas and the blank elongates to form a shaped part determined by the shape of the mold.

Figure 1:
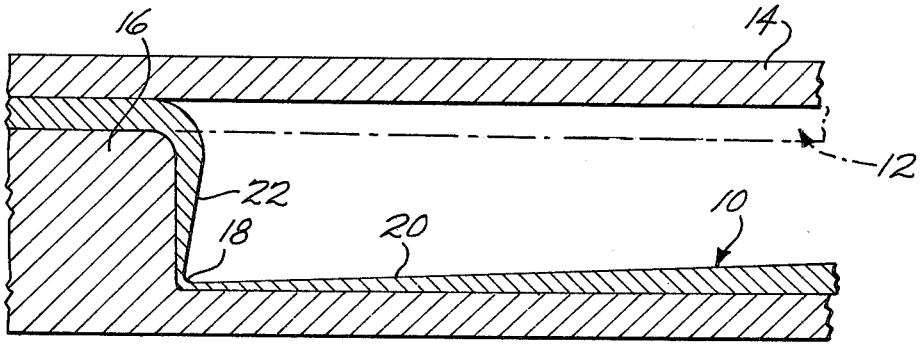
Fig. 1 PRIOR ART
FIG. 1 is a fragmented side elevational view of a mold showing prior art of a part formed from a constant thickness metal blank.

FIG. 1 shows the prior state of the art in superplastic forming of metals. In that figure, finished part 10 was formed from a metal blank shown in phantom lines as a flat sheet 12. The blank is placed between mold cover 14 and female mold part 16 and formed under temperature and pressure into the shaped part 10. The shaped part is thinned down considerably at 18, is thinned down to a lesser extent along a line at 20, and is thinned down to a still lesser extent along the line at 22. The amount of the thinning is dependent on the amount the various parts of the blank must elongate to assume the finished shape.

Figure 2:
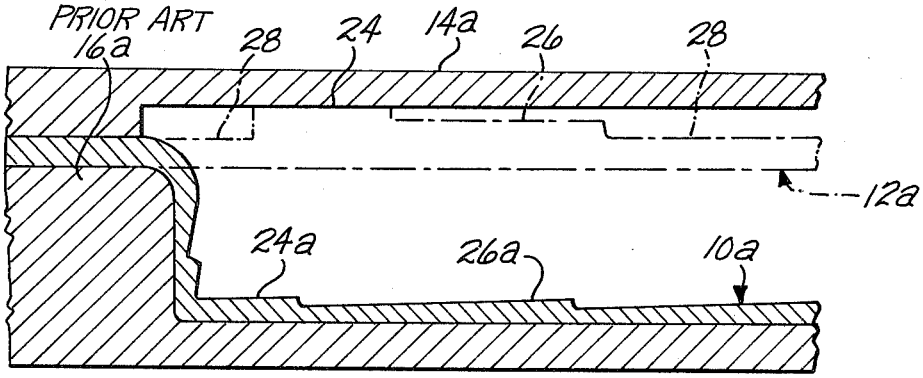
FIG. 2 is a fragmented side elevational view of the mold of FIG. 1 showing a part formed from a sculptured metal blank as practiced by this invention.

In FIG. 2 as practiced by this invention, the blank 12A is sculptured prior to being placed in the mold. The blank can be formed from the flat sheet stock by machining or chemical milling or coining or other known means. In this embodiment the blank is in three steps with the thickest part 24 located in the area to be subjected to the greatest elongation, with the area 26 subjected to the next greatest elongation and area 28 the least amount of elongation. The blank 12A is placed between mold cover 14A and female mold part 16A and is superplastically formed into finished part 10A with area 24 shaped as at 24A and area 26 shaped as at 26A.

Figure 5:
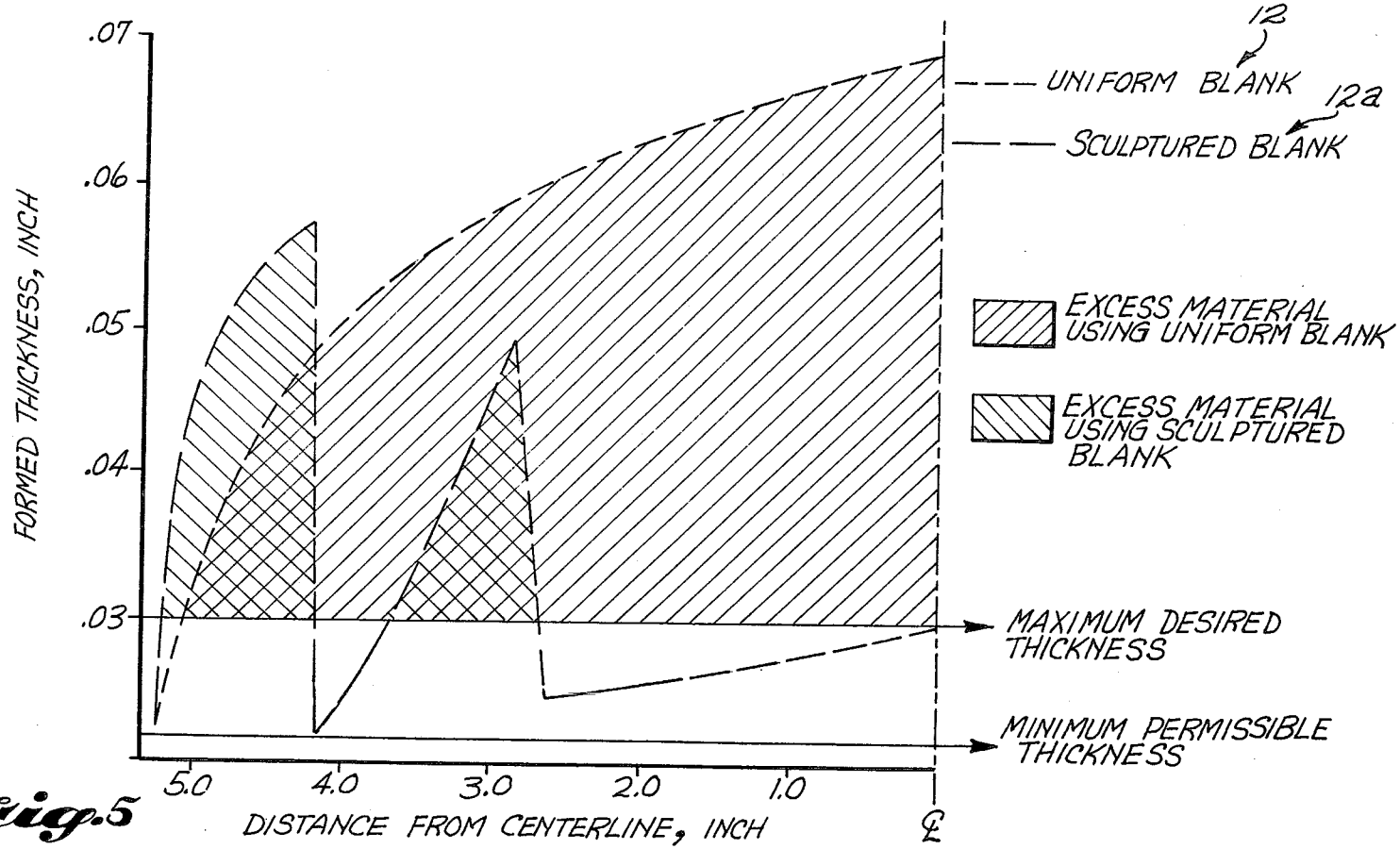
FIG. 5 shows a graph of formed part thickness versus elongation from a blank.

FIG. 5 graphically shows the amount of excess material one has in a formed part when comparing parts from the uniform thickness blank 12 versus the sculptured blank 12A. The number of steps to use in sculpturing depends upon the complexity of the mold and the need for weight control of the finished part.

Figure 3:
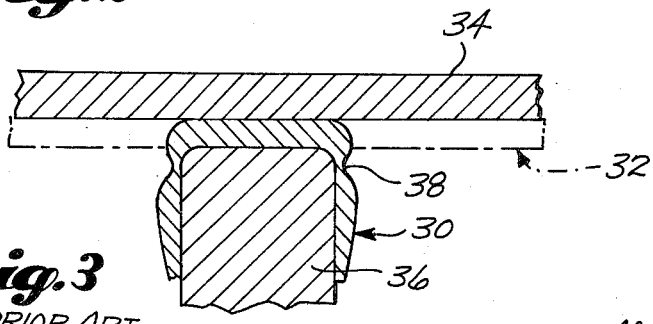
Fig. 3 PRIOR ART
FIG. 3 is a fragmented side elevational view of a mold for a different shaped part showing prior art of a part formed from a constant thickness metal blank.
Figure 4:
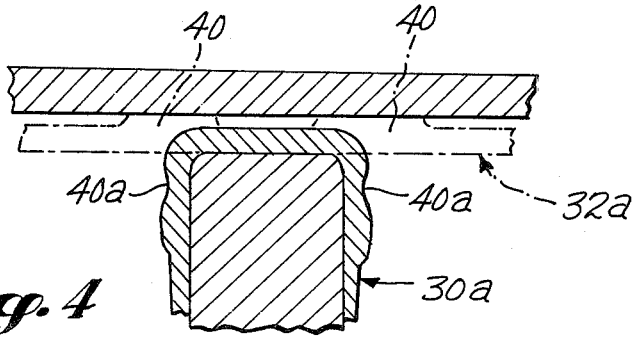
FIG. 4 is a fragmented side elevational view of the mold of FIG. 3 showing a part formed from a sculptured metal blank as practiced by this invention.

FIG. 3 shows prior art forming with a different shaped mold. In that figure, finished part 30 is formed from a flat metal blank 32. The blank is placed between mold cover 34 and projecting mold 36. During the forming of the part in the shaped mold, the area of the greatest elongation and therefore thinning is located in the part at 38. In FIG. 4 the blank 32A is sculptured with a pair of raised steps 40 and when the blank is superplastically formed into part 30A these thickened areas are as shaped at 40A. This gives a finished part that is lighter in weight than the prior art and does not require post maching.

In operation, the minimum permissible thickness and the maximum desired thickness of the finished part is determined. The metal stock is then formed into sculptured part to become the blank for forming into the finished part. The metal stock is sculptured in steps with the thickest step in the area being subjected to the greatest elongation. The sculptured blank is then introduced into a mold, subjected to elevated temperature, then pressure is introduced by an inert gas to form the finished part.

We claim:

1. An article of manufacture superplastically formed by a process comprising: selectively removing material from essentially flat metal stock for providing a stepped blank, placing the stepped blank in a mold with the thicker parts located where the blank will be subjected to greatest elongation, heating and pressurizing the mold for superplastically forming the stepped blank into a shaped part.

2. A method of superplastically forming a lightweight part comprising: determining the minimum permissible thickness for a formed part, determining the maximum desired thickness of the formed part, sculpturing a metal blank for shaping into the formed part, introducing the sculptured blank into a mold, and heating and pressurizing the mold with blank and forming the blank into the part.

3. An article of manufacture superplastically formed by a process comprising: establishing areas of an essentially flat metal blank that will be subjected to extensive tensile elongation, sculpturing the flat metal blank into steps with the thickest step in an area of the metal blank to be subjected to the greatest elongation, placing the sculptured metal blank in a mold, and superplastically forming a part from the sculptured metal blank.

4. An article of manufacture superplastically formed by a process as set out in claim 3 further comprising sculpturing the blank by machining.

5. An article of manufacture superplastically formed by a process as set out in claim 3 further comprising sculpturing the blank by chemical milling.

6. An article of manufacture superplastically formed by a process as set out in claim 3 further comprising sculpturing the blank by coining.

* * * * *